US011231001B2

(12) United States Patent
Filippi et al.

(10) Patent No.: US 11,231,001 B2
(45) Date of Patent: Jan. 25, 2022

(54) FUEL INJECTOR

(71) Applicant: Continental Automotive GmbH, Hannover (DE)

(72) Inventors: Stefano Filippi, Castel' Anselmo Collesalvetti (IT); Mauro Grandi, Leghorn (IT); Francesco Lenzi, Leghorn (IT); Valerio Polidori, Leghorn (IT)

(73) Assignee: VITESCO TECHNOLOGIES GMBH, Hannover (DE)

( * ) Notice: Subject to any disclaimer, the term of this patent is extended or adjusted under 35 U.S.C. 154(b) by 169 days.

(21) Appl. No.: 15/027,074

(22) PCT Filed: Sep. 29, 2014

(86) PCT No.: PCT/EP2014/070828
§ 371 (c)(1),
(2) Date: Apr. 4, 2016

(87) PCT Pub. No.: WO2015/049210
PCT Pub. Date: Apr. 9, 2015

(65) Prior Publication Data

US 2016/0252064 A1 Sep. 1, 2016

(30) Foreign Application Priority Data

Oct. 4, 2013 (EP) ..... 13187337

(51) Int. Cl.
*F02M 61/08* (2006.01)
*F02M 63/00* (2006.01)
(Continued)

(52) U.S. Cl.
CPC ..... *F02M 61/08* (2013.01); *F02M 45/083* (2013.01); *F02M 61/10* (2013.01);
(Continued)

(58) Field of Classification Search
CPC ..... F02M 61/08; F02M 61/10; F02M 61/20; F02M 45/083; F02M 47/027;
(Continued)

(56) References Cited

U.S. PATENT DOCUMENTS 4,114,125 A * 9/1978 Komatsu ..... H01F 7/1607 188/317
4,344,575 A * 8/1982 Seifert ..... F02M 45/083 239/533.5
(Continued)

FOREIGN PATENT DOCUMENTS

DE 4340874 A1 6/1995 ..... F02M 45/08
DE 10054182 A1 5/2002 ..... F02M 51/06
(Continued)

OTHER PUBLICATIONS

European Search Report, Application No. 13187337.4, 5 pages, dated May 20, 2014.
(Continued)

*Primary Examiner* — Joseph A Greenlund
*Assistant Examiner* — Juan C Barrera
(74) *Attorney, Agent, or Firm* — Slayden Grubert Beard PLLC

(57) ABSTRACT

The present disclosure relates to a fuel injector for injecting fuel into a combustion engine. It may comprise a valve with a movable needle, two springs pushing the needle toward the closed position, and an actuator for opening the valve. The needle may be in a fuel reservoir of a valve body. The actuator may supply pressurized fuel to the fuel reservoir so that the fuel pressure forces the needle away from the closed position against the spring force of the first spring or the first and second springs, respectively. There may be play between the second spring and the needle when the needle is in the closed position.

16 Claims, 7 Drawing Sheets

(51) Int. Cl.
*F02M 45/08* (2006.01)
*F02M 61/20* (2006.01)
*F02M 61/10* (2006.01)

(52) U.S. Cl.
CPC ..... *F02M 61/20* (2013.01); *F02M 63/0007* (2013.01); *F02M 63/0075* (2013.01); *F02M 2200/26* (2013.01); *F02M 2200/50* (2013.01)

(58) Field of Classification Search
CPC ..... F02M 63/0007; F02M 63/0075; F02M 63/001; F02M 2200/26; F02M 2200/50; F02M 2200/502; F02M 61/161; F02M 61/205; F02M 59/18; F02M 63/0003; F02M 2547/006; F16K 31/004; F16K 1/2071; F16K 1/2266; F16K 17/044; F16K 31/1221; F16K 31/566; F16F 3/02; F16F 3/04; F16F 3/093
USPC ..... 239/584–585.5, 5, 87, 88–92, 96, 900, 239/533.2–533.12, 337
See application file for complete search history.

(56) References Cited

U.S. PATENT DOCUMENTS 4,537,359 A * 8/1985 Skinner ..... F02M 45/083 239/533.6
5,282,577 A * 2/1994 Neitz ..... F02M 45/08 137/625.37
5,609,300 A * 3/1997 Conatser ..... B05B 1/3006 239/332
5,632,447 A * 5/1997 Christ ..... F02M 45/083 239/533.4
5,647,540 A * 7/1997 Buckley ..... F02M 45/083 239/533.2
7,175,112 B2 * 2/2007 Uhlmann ..... F02M 47/027 239/533.12
2006/0255185 A1 4/2006 Cristiani et al. ..... 239/533.7
2006/0284740 A1 * 12/2006 Boecking ..... F02M 51/0603 341/13
2007/0090724 A1 * 4/2007 Kato ..... F02M 47/027 310/311
2010/0140380 A1 6/2010 Gruendl et al. ..... 239/585.3
2011/0168812 A1 * 7/2011 Frasch ..... F02M 47/027 239/533.3

FOREIGN PATENT DOCUMENTS

EP 1079098 A2 2/2001 ..... F02M 51/06
EP 2011995 A2 1/2009 ..... F02M 47/02
GB 2326199 A 12/1998 ..... F02M 45/00
JP 04231675 A 8/1992 ..... F02M 45/08
JP 2007113492 A 5/2007 ..... F02M 47/02
WO 2012/159923 A1 11/2012 ..... F02B 7/06
WO 2015/049210 A1 4/2015 ..... F02M 61/08

OTHER PUBLICATIONS

International Search Report and Written Opinion, Application No. PCT/EP2014/070828, 9 pages, dated Nov. 4, 2014.
Korean Office Action, Application No. 2017063653209, 12 pages, dated Sep. 11, 2017.
Chinese Office Action, Application No. 201410454276.7, 9 pages, dated Jun. 22, 2017.

* cited by examiner

FUEL INJECTOR

CROSS-REFERENCE TO RELATED APPLICATIONS

This application is a U.S. National Stage Application of International Application No. PCT/EP2014/070828 filed Sep. 29, 2014, which designates the United States of America, and claims priority to EP Application No. 13187337.4 filed Oct. 4, 2013, the contents of which are hereby incorporated by reference in their entirety.

TECHNICAL FIELD

The present disclosure relates to fuel injectors and, more specifically, to fuel injectors for use with a combustion engine in a motor vehicle.

BACKGROUND

A fuel injector for injecting fuel into a combustion engine usually comprises a valve opened by means of an electrically driven actuator against the force of a spring. Different constructions are known in the art, comprising electromagnetic or piezo actuators, digital or servo models and actuators for different fuel types such as gasoline or diesel.

US 2006/0255185 A1 describes a fuel injector with an electromagnetic actuator in which the valve comprises a needle and the valve opens when the needle is moved in a direction of a nozzle of the injector.

EP 2011995 A2 relates to a common-rail injector with an outward opening valve element and a servo valve. The servo valve reduces the fuel pressure in a control volume for opening the valve element.

DE 4340874 A1 1995A discloses a fuel injection nozzle for preinjection and main injection which has a nozzle holder in which two closing springs are arranged coaxially, one spring acts continuously on the valve needle via a central pressure bolt and the other spring acts on the valve needle, via a pressure ring surrounding the pressure bolt, once the valve needle has passed through a pretravel. In order to prevent the connection between the low pressure space at the valve needle and the pressure-relieved spring chamber being interrupted in the pretravel position when an intermediate pressure disk—being arranged between the valve needle and the pressure bolt and the pressure ring—comes into axial contact with the pressure ring which is supported on the shoulder of the intermediate disk, bridging channels are arranged at least in the intermediate pressure disk.

An injector is usually designed to work with fuel in a certain range of pressure only. Should there be a defect in the fuel system so that the pressure of the fuel that arrives at the injector is lower, the injector may exhibit reduced performance. In some cases, it may be hard to operate the combustion engine properly if fuel pressure falls lower than a predetermined threshold. However, it is desirable to operate the combustion engine even if fuel pressure is low so that a "limp home" functionality can be implemented which may allow a driver to move the motor vehicle to a service location in case of a problem in the fuel pressurisation system.

SUMMARY

It is therefore useful to provide a fuel injector that shows good performance under both normal and reduced fuel pressure conditions.

According to the teachings of the present disclosure, a fuel injector for injecting fuel into a combustion engine may comprise a valve with a movable needle for opening and closing the valve, an actuator for moving the needle into an open position and two springs mounted in parallel to move the needle into a closed position, wherein there is a play between the second spring and the needle when the needle is in the closed position.

That there is a play between the second spring and the needle when the needle is in the closed position means in particular that the needle has a spring seat and the second spring has an end face which comes in mechanical contact with the spring seat when the valve needle is displaced away from the closed position towards the open position and which is spaced apart from the spring seat when the needle is in the closed position.

In particular, the first spring, and only the first spring, may be preloaded when the needle is in the closed position to retain the needle in the closed position while the actuator is de-energized.

The second spring may expediently be unstressed while the needle is in the closed position.

When the actuator is operated, it initially moves the needle against the force of the first spring and further along the travel of the needle against the force of both springs. This allows achieving a sufficient opening of the valve under both standard operating conditions and reduced fuel pressure. This way, a sufficient throughput of fuel through the injector can be ensured.

In some embodiments, the second spring is stiffer than the first spring. This allows reducing the force necessary to open the valve to a small value as long as only the first spring engages with the needle and increase the operating force steplike when the second spring also engages. Through this, safe operation under both reduced and normal fuel pressures may be achieved.

In some embodiments, there is also a needle stopper to confine needle movement to a predetermined travel position in which both springs are engaged. Depending on the design of the injector, the fuel pressure may take influence on the distance the needle is travelled. The needle stopper may make sure that the valve is not opened excessively, even when fuel pressure is high.

In some embodiments, the needle stopper is integrated with the second spring. To this ends, the second spring may be configured such that it will not compress more than a certain travel.

Different types of spring may be used to accomplish the integrated needle stopping functionality.

In some embodiments, the needle stopper is integrated in a valve body of the fuel injector. For example, the needle is received in a cavity of the valve body. The needle and the valve body may be shaped such that the needle comes into engagement with the needle stopper when it reaches the predetermined travel position and the needle stopper blocks further displacement of the needle with respect to the valve body away from the closed position.

In some embodiments, the first spring comprises a helical spring. The helical spring may implement soft spring characteristics so that operation force does not vary much over the travel of the needle. This is especially helpful when the first spring is softer than the second spring.

The second spring may also comprise a helical spring. However, in some embodiments the second spring comprises a cylindrical body with radial recesses. In particular the cylindrical body is a cylinder shell wherein the cylinder shell is perforated by the radial recesses. In this, the second spring may have a high stiffness and it may also implement the above mentioned needle stopper functionality.

In some embodiments, the needle and the springs are mounted coaxially. This may help save installation space so that the injector may be compact or slender.

In some embodiments, the needle is configured to open the valve when the needle is moved towards a nozzle end of the injector. This configuration of an injector is also known as outward opening configuration. The outward opening injector may help to operate the two different springs in accordance with different fuel pressures.

In some embodiments, the actuator comprises a solenoid. The solenoid may be advantageous over a piezo type actuator in that it provides a larger travel of the needle.

In some embodiments, the valve is of the servo type.

In some embodiments, the needle is received in a fuel reservoir of a valve body of the fuel injector. The actuator may supply pressurized fuel to the fuel reservoir so that the fuel pressure forces the needle away from the closed position against the spring force of the first spring or the first and second springs, respectively. The actuator may comprise a second valve for supplying pressurized fuel to the fuel reservoir.

BRIEF DESCRIPTION OF THE DRAWINGS

The teachings of the present disclosure will now be described in more detail with reference to the enclosed drawings, in which.

DETAILED DESCRIPTION

Figure 1:
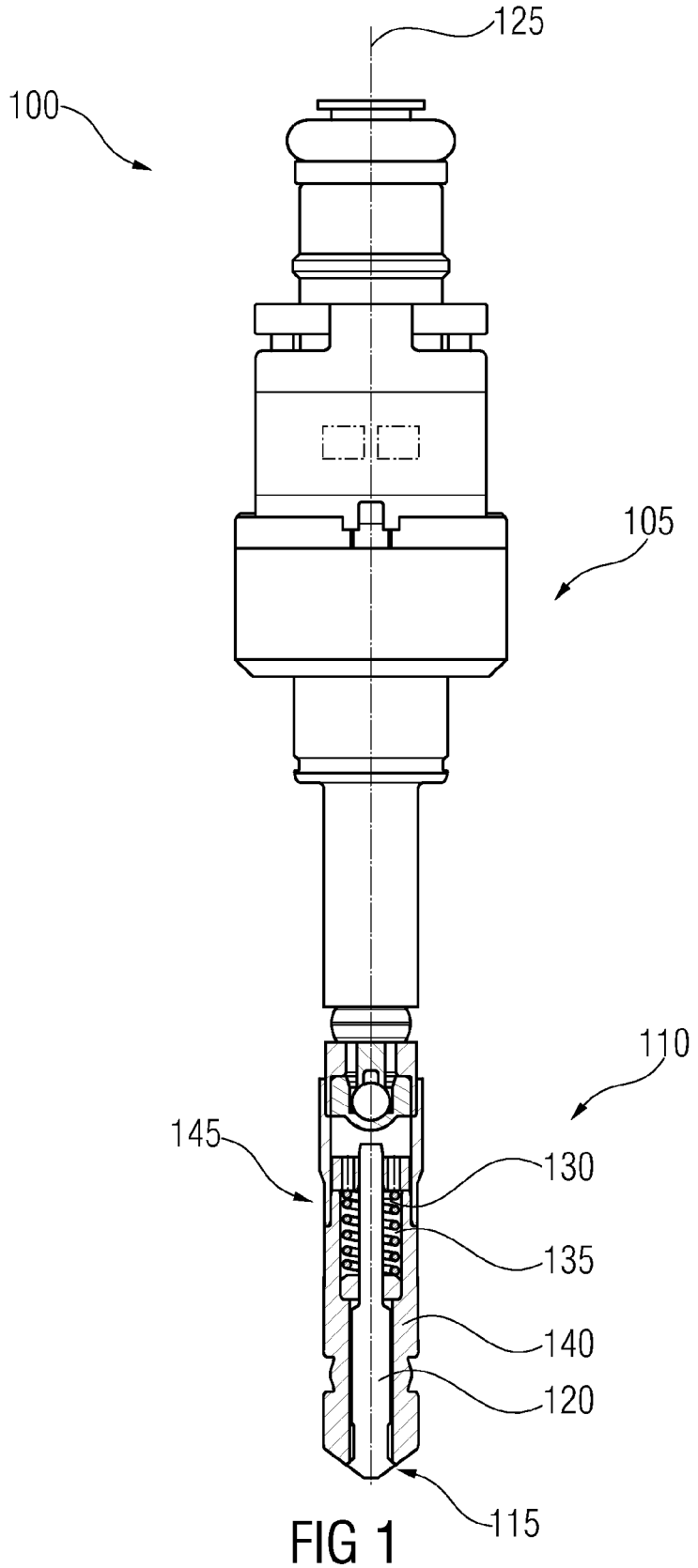
FIG. 1 shows an injector for injecting fuel into a combustion engine.

FIG. 1 shows an injector 100 for injecting fuel into a combustion engine. The injector 100 comprises an actuator 105, and a valve 110 for allowing or stopping a flow of fuel out of a nozzle 115 and into the combustion engine. The valve 110 comprises a valve body 140 and a needle 120 that can be moved between an open position and a closed position. The nozzle is in particular formed by a downstream end of the valve body 140 together with a downstream end of the needle 120.

In some embodiments, the injector 100 is of the servo type and that the needle 120 may also be actuated into other positions between the open and the closed position. Injector 100 and valve 110, respectively, may be of the outward opening type where the needle is in the closed position when its upstream end is furthest away from nozzle 115 and the needle 120 must be moved towards the nozzle 115 for opening the valve 110. In other words, the needle 120 is displaceable in flow direction for opening the valve 110.

The actuator 105 is configured to move the needle 120 towards the open position against the force of a first spring 130 and a second spring 135 which are mounted in parallel, wherein each spring 130, 135 drives the needle 120 towards the closed position.

The springs 130, 135 are supported by the valve body 140. In other words, the valve body 140 comprises a spring seat for each of the first and second springs 130, 135.

As shown in FIG. 1, the needle 120 is received in a fuel reservoir 141 of a valve body 140 of the fuel injector 100. The first and second springs 130, 135 are also positioned in the fuel reservoir 141. In particular, the first and second springs overlap completely with the needle 120 in axial direction. In particular, the needle 120 projects beyond both springs 130, 135 on both axial ends.

The actuator 105 comprises a second valve 150 for supplying pressurized fuel to the fuel reservoir 141. The pressurized fuel in the fuel reservoir 141 forces the needle 120 away from the closed position against the spring force of the first spring 130 or the first and second springs 130, 135, respectively for opening the valve.

Figure 2:
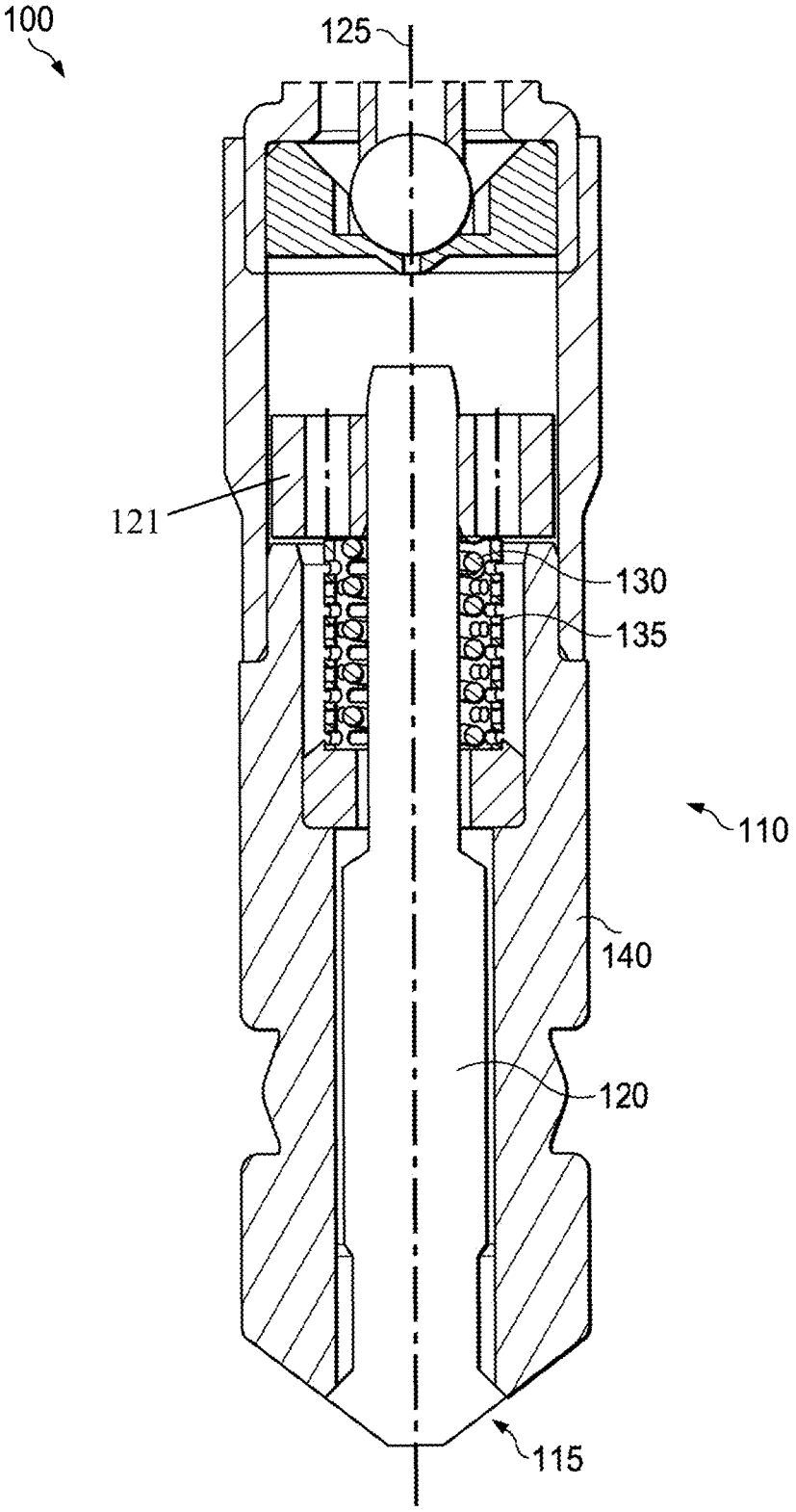
FIG. 2 shows a detail of the injector of FIG. 1.

FIG. 2 shows a detail of the injector 100 of FIG. 1 magnified from the picture in FIG. 1. In this representation it can be seen that the needle 120 and both springs 130, 135 are mounted coaxially with respect to the longitudinal axis 125. The first spring 130 lies between the needle 120 and the second spring 135 in a radial direction. In the embodiment shown in FIG. 2 the first spring 130 is of the helical type while the second spring 135 has a shape that is discussed below in more detail with respect to FIG. 4. A needle stopper 145 may be present to limit the movement of the needle 120 towards the open position. In addition, as shown in FIG. 2, the injector 100 may include a second valve 150 for supplying pressurized fuel to the fuel reservoir.

Figure 3:
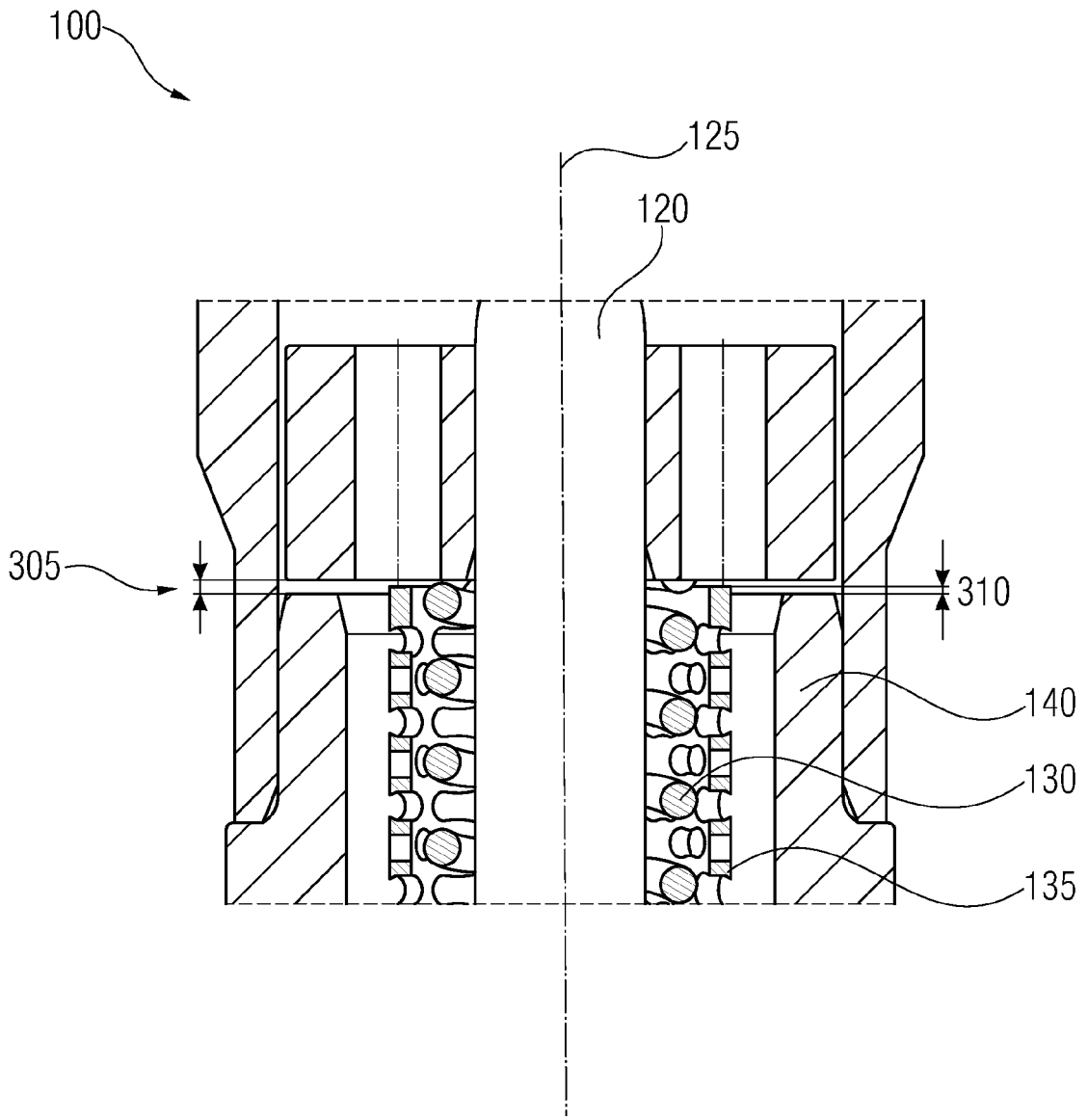
FIG. 3 shows a detail of the injector of FIGS. 1 and 2.

FIG. 3 shows a detail of the injector 100 of FIGS. 1 and 2. Displayed is a portion of valve 110 in which the springs 130 and 135 lie. FIG. 3 is a further magnification of a portion of FIG. 2.

While the first spring 130 engages axially with the valve body 140 and the needle 120 independent of the position of the needle 120, the second spring 135 is configured to leave a play 305 towards the needle 120 when the needle 120 is in the closed position. That is, the second spring 135 does not engage with the needle 120 and does not exert a force between the valve body 140 and the needle 120 when the needle 120 is in the closed position.

Specifically, the needle comprises a seat element 121 which laterally overlaps the first and second springs 130, 135 to provide spring seats for the first and second spring 130, 135, respectively. In the present embodiment, the seat element 121 is fixed to a shaft of the needle 120 which extends axially through the first and second springs 130, 135. When the needle is in the closed position, there is an axial gap—the play 305—between the second spring 135 and the seat element 121. The seat element 121 is in particular positioned upstream of the spring seats of the valve body 140 for the first and second springs 130, 135.

The needle is in the closed position when the actuator 105 is not energized. By energizing the actuator 105, pressurized fuel is supplied to the fuel reservoir 141 via the second valve 150 so that the needle 120 is driven from the closed position towards the open position by the fuel pressure of the pressurized fuel in the fuel reservoir 141. Firstly, as long as the length of the axial gap 305 is non-zero, only the first spring 130 works against the fuel pressure. After the needle 120 has moved far enough to close the axial gap 305 between the seat element 121 and the second spring 135, it may be moved even further along a length 310 on which both the first spring 130 and the second spring 135 engage between the body 140 and the needle 120—both the first spring 130 and the second spring 135 abut the seat element 121—and together work against said opening force effected by the fuel pressure in the fuel reservoir 141.

In some embodiments, the first spring 130 has softer spring characteristics than the second spring 135. The first spring 130 may be of the helical type. The first spring 130 may be preloaded when the needle 120 is in the closed position.

Figure 4:
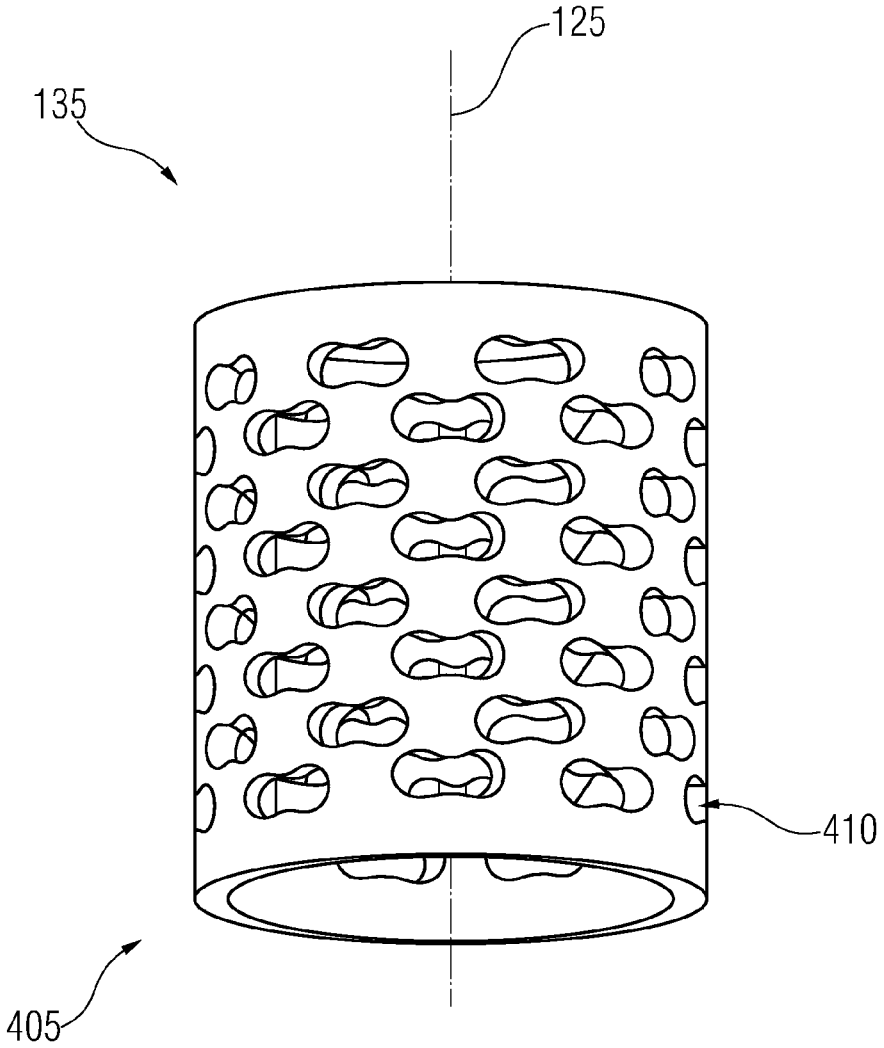
FIG. 4 shows the second spring of the injector of FIGS. 1 to 3.

FIG. 4 shows the second spring 135 of the injector 100 of FIGS. 1 to 3. In the given embodiment the second spring 135 comprises a cylindrical body 405 with radial recesses 410. In particular, the cylindrical body 405 is a cylinder shell with a central axial cavity through which the needle 120 extends and in which preferably the first spring 130 is received. The recesses 410 are distributed on circumferences of the body 405 and each recess 410 extends along a portion of said circumference. In the given example, each recess 410 has the shape of two adjacent circular holes that are connected with a slot. The circumferences with the recesses 410 which perforate the cylinder shell of the cylindrical body 405 are stacked in a direction along the longitudinal axis 125. The recesses 410 may be distributed such that a helical pattern emerges. In other embodiments, the recesses 410 may follow a different layout over the cylindrical body 405.

The second spring 135 may be configured to restrict the travel of the needle 120 towards the open position to a certain amount. In this, the second spring 135 also acts as a needle stopper 145.

Figure 5:
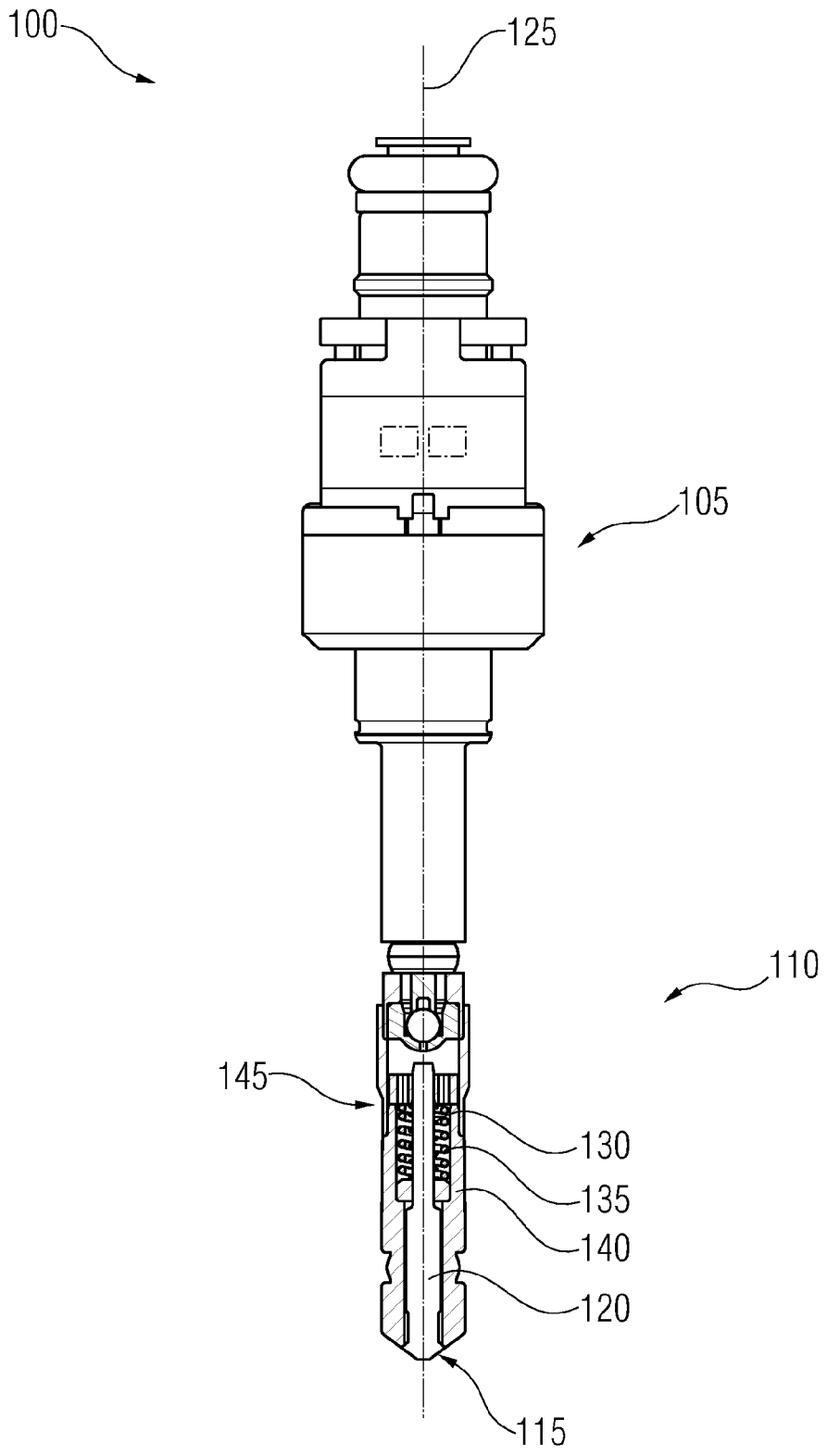
FIG. 5 shows a different embodiment of the injector of FIG. 1.

FIG. 5 shows a fuel injector 100 according to teachings of the present disclosure. The fuel injector 100 corresponds in general to the injector 100 of FIG. 1. In the present embodiment, however, the second spring 135 is in the shape of a helical spring, rather than as the cylindrical body 405 of FIG. 4.

Figure 6:
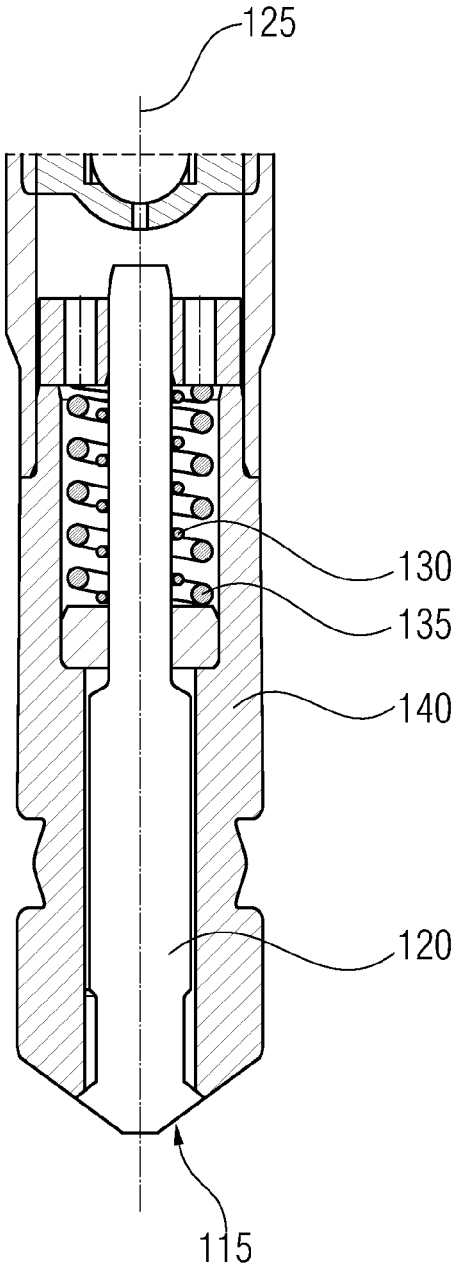
FIG. 6 shows a detail of the injector of FIG. 5.

FIG. 6 shows a detail of the injector 100 of FIG. 5 similar to the display of FIG. 2. The first spring 130 is again disposed between the second spring 135 and the needle 120 in a radial direction with respect to longitudinal axis 125.

Figure 7:
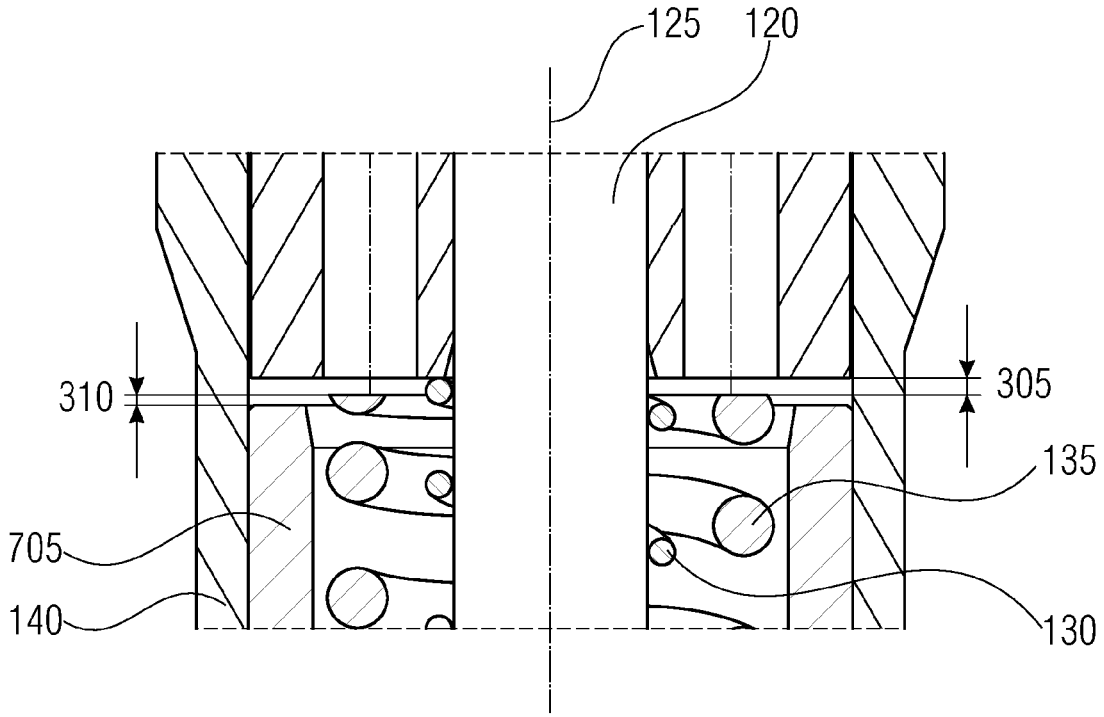
FIG. 7 shows a detail of the injector of FIGS. 5 and 6.

FIG. 7 shows a detail of the injector 100 of FIGS. 5 and 6 in a view similar to that of FIG. 3. When the needle 120 is in the closed position, the axial gap 305 between the second spring 135 and seat element 121 of the needle 120 is established. To prevent the needle 120 from being moved towards the nozzle end of injector 100 excessively, a needle stopper 145. The needle stopper 145 is represented by an upstream surface of a stop collar 705, which upstream surface faces towards the seat element 121 and may have a surface normal parallel to the longitudinal axis 125. The stop collar 705, for example, forms a step in a circumferential side wall of the fuel reservoir 141. The stop collar 705 is comprised by the valve body 104 fixed to the valve body 140 and configured such that the needle 120—in particular the seat element 121 or another element attached to the shaft of the needle 120—will run up against the stop collar 705 in the direction of the longitudinal axis 125 when the needle 120 is moved from the closed position towards the open position.

What is claimed is:

1. A fuel injector for injecting fuel into a combustion engine, the injector comprising:

a valve with a needle for opening or closing the valve by moving on a longitudinal axis, the needle received in a fuel reservoir of a valve body of the fuel injector;

a first spring resisting movement of the needle away from a closed position, the first spring having a first end and a second end;

a second spring resisting movement of the needle away from the closed position, the second spring having a first end and a second end, wherein the second spring is stiffer than the first spring;

the needle including a first seat element defining a first planar annulus, wherein the first end of the first spring and the first end of the second spring face the first seat element and contact the first seat element as the needle opens the valve;

the valve body including a second seat element defining a second planar annulus, wherein the second end of the first spring and the second end of the second spring face the second seat element and contact the second seat element; and an actuator for moving the needle into an open position, the actuator operable to supply pressurized fuel to the fuel reservoir so that the fuel pressure forces the needle away from the closed position against the spring force of the first spring or the first and second springs, respectively, for opening the valve, wherein in the closed position of the needle, the first end of the first spring is in contact with the first seat element and the second end of the first spring is in contact with the second seat element and the first end of the second spring is spaced apart from the first seat element by an axial gap along the longitudinal axis, the second end of the second spring is in contact with the second seat element and no compressive force is exerted on the second spring by either the first seat element or the second seat element.

2. A fuel injector according to claim 1, wherein the needle opens the valve when the needle moves towards a nozzle end of the injector.

3. A fuel injector according to claim 1, further comprising a needle stopper to confine needle movement to a predetermined travel in which both springs are engaged.

4. A fuel injector according to claim 1, wherein the first spring comprises a helical spring.

5. A fuel injector according to claim 1, wherein the second spring comprises a cylindrical body with radial recesses.

6. A fuel injector according to claim 1, wherein the needle and the springs are mounted coaxially.

7. A fuel injector according to claim 1, wherein the actuator comprises a solenoid.

8. A fuel injector according to claim 1, wherein the valve is of the servo type.

9. A fuel injector according to claim 1, wherein the actuator comprises a second valve for supplying the pressurized fuel to the fuel reservoir.

10. A combustion engine comprising:

a combustion chamber;

a valve for dosing a fuel into the combustion chamber;

a needle for opening or closing the valve by moving on a longitudinal axis, the needle received in a fuel reservoir of a valve body;

a first spring resisting movement of the needle away from a closed position, the first spring having a first end and a second end;

a second spring resisting movement of the needle away from the closed position, the second spring having a first end and a second end, wherein the second spring is stiffer than the first spring;

the needle including a first seat element defining a first planar annulus, wherein the first end of the first spring and the first end of the second spring face the first seat element and contact the first seat element as the needle opens the valve;

the valve body including a second seat element defining a second planar annulus, wherein the second end of the first spring and the second end of the second spring face the second seat element and contact the second seat element; and an actuator for moving the needle into an open position, the actuator operable to supply pressurized fuel to the fuel reservoir so that the fuel pressure forces the needle away from the closed position against the spring force of the first spring or the first and second springs, respectively, for opening the valve, wherein in the closed position of the needle, the first end of the first spring is in contact with the first seat element and the second end of the first spring is in contact with the second seat element and the first end of the second spring is spaced apart from the first seat element by an axial gap along the longitudinal axis, the second end of the second spring is in contact with the second seat element and no compressive force is exerted on the second spring by either the first seat element or the second seat element.

11. A combustion engine according to claim 10, further comprising a needle stopper to confine needle movement to a predetermined travel in which both springs are engaged.

12. A combustion engine according to claim 10, wherein the first spring comprises a helical spring.

13. A combustion engine according to claim 10, wherein the second spring comprises a cylindrical body with radial recesses.

14. A combustion engine according to claim 10, wherein the needle and the springs are mounted coaxially.

15. A combustion engine according to claim 10, wherein the valve is of the servo type.

16. A combustion engine according to claim 10, wherein the actuator comprises a second valve for supplying the pressurized fuel to the fuel reservoir.

* * * * *